US006691721B2

(12) United States Patent
Apple

(10) Patent No.: US 6,691,721 B2
(45) Date of Patent: Feb. 17, 2004

(54) FAN UMBRELLA

(76) Inventor: Phillip C. Apple, RD #1, Box 72A, Mount Pleasant Mills, PA (US) 17853

( * ) Notice: Subject to any disclaimer, the term of this patent is extended or adjusted under 35 U.S.C. 154(b) by 113 days.

(21) Appl. No.: 10/090,659

(22) Filed: Mar. 5, 2002

(65) Prior Publication Data

US 2003/0168090 A1 Sep. 11, 2003

(51) Int. Cl.[7] ..... A45B 3/00; A45B 23/00
(52) U.S. Cl. ..... 135/16; 417/313
(58) Field of Search ..... 135/16; 417/313

(56) References Cited

U.S. PATENT DOCUMENTS 4,928,718 A 5/1990 Apple
5,020,557 A 6/1991 Apple
5,172,711 A * 12/1992 Mueller et al. ..... 135/16
5,337,989 A 8/1994 Apple
5,711,332 A 1/1998 Apple
5,765,582 A * 6/1998 Molnar ..... 135/16
6,230,723 B1 * 5/2001 Hixson ..... 135/16
6,325,084 B1 * 12/2001 Cohen ..... 135/16

FOREIGN PATENT DOCUMENTS

JP 2002-199916 * 7/2002 ..... A45B/3/00

* cited by examiner

*Primary Examiner*—Robert Canfield
(74) *Attorney, Agent, or Firm*—Thomas R. Shaffer, Esq.

(57) ABSTRACT

The present invention provides an umbrella fan which includes a pole, an upper hub, main umbrella support members, a lower hub, lower umbrella support arms and a main umbrella fabric cover attached to the main umbrella support members. At least one fan member is attached to the main umbrella fabric cover and depends downwardly therefrom. A motor mounted to the pole is operably connected to at least one of the upper hub and the lower hub and is adapted to rotate the upper hub, the main umbrella support members, the lower hub, the lower support arms and the main umbrella fabric cover and at least one fan member relative to the pole. This causes the fan member to direct a flow of air downwardly when the motor is operating.

22 Claims, 3 Drawing Sheets

FAN UMBRELLA

BACKGROUND OF THE INVENTION

1. Field of the Invention

The present invention relates to a fan umbrella. More specifically, it relates to a fan umbrella which has at least one fan member attached directly and depending downwardly from a main umbrella fabric cover.

2. Description of the Prior Art

A variety of table umbrella fans have been proposed. A number of these existing devices utilize separate and independent fan blades which are placed at a location beneath the umbrella. Examples of such devices are found in Molnar, IV, U.S. Pat. No. 6,298,866; Hixson, U.S. Pat. No. 6,230,723; Valdner, U.S. Pat. No. 5,349,975; Mozdzanowski, U.S. Pat. No. 5,273,062; and Hopkins, U.S. Pat. No. 5,007,811. Other known umbrellas which provide either a fan or some type of venting actually modify the structure of the uppermost fabric cover of the umbrella. For example, Neal, U.S. Pat. No. 5,967,161 utilizes a foldable cover. Brown, U.S. Pat. No. 5,868,152 discloses a rotating patio umbrella fan which utilizes petals instead of a main umbrella fabric cover. Molnar, IV, U.S. Pat. No. 5,765,582 likewise provides a number of independent fan blades in lieu of a main umbrella fabric cover. Finally, Bulgatz, U.S. Pat. No. 5,348,034 discloses a wind resistant umbrella and Buzzella et al., U.S. Pat. No. 4,023,582 discloses a vented metal umbrella kit.

There remains a need for a table umbrella which is lightweight, collapsible and which utilizes one or more fan blades which attach directly to a main umbrella fabric cover. With such an arrangement, complete protection from rain and sun are provided while allowing a rotatable umbrella design to provide cooling for individuals seated beneath the umbrella.

SUMMARY OF THE INVENTION

In its simplest form the present invention provides a fan umbrella comprising a pole; an upper hub; a plurality of main umbrella support members; a lower hub; a plurality of lower umbrella support arms; a main umbrella fabric cover attached to said main umbrella support members; at least one fan member attached to said main umbrella fabric cover and depending downwardly from said main umbrella fabric cover; and drive means mounted to said pole operably connected to said one of said upper hub and said lower hub and adapted to rotate said upper hub, said main umbrella support members, said lower hub, said lower umbrella support arms, said main umbrella fabric cover and said at least one fan member relative to said pole whereby said at least one fan member directs a flow of air downwardly when said drive means is operating.

Preferably the umbrella is movable between an open position and a closed position with said lower hub slidable on said pole between an upper open position and a lower closed position. Said main umbrella support members preferably have an inner end, an outer end and a central portion, and said main umbrella support members are pivotally mounted at said inner end thereof to said upper hub and extend outwardly therefrom. Said lower hub 50 is also preferably slidable on said pole between an upper open position and a lower closed position. Said plurality of lower umbrella support arms are each preferably pivotally connected at a first end thereof to a central portion of one of said main umbrella support members and pivotally connected at a second end thereof to said lower hub.

Preferably the at least one fan member is formed of a fabric material such as canvas, cotton, nylon, acrylic or other similar material. Preferably said at least one fan member is generally triangular in shape and consists of a plurality of fan members having the same number of fan members as main umbrella support members although a fewer number of fan members will still function.

Preferably said at least one fan member has a top edge, a bottom edge, and an inner edge, and has an outer portion of a top edge thereof attached to main umbrella fabric cover. It is also preferred that said outer portion of said top edge of said at least one fan member is sewn to said main umbrella fabric cover. Alternatively, said outer portion of said top edge of said at least one fan member may be removably attached to said main umbrella fabric cover with at least one of a zipper, Velcro fasteners, magnetic fasteners, and snaps.

Preferably, an inner portion of a top edge of said at least one fan member is removably attached to a main umbrella support member with at least one of a zipper, Velcro fasteners, magnetic fasteners, and snaps. An inner portion of a bottom edge of said at least one fan member is preferably removably attached to a lower support arm also with at least one of a zipper, Velcro fasteners, magnetic fasteners, and snaps.

An inner edge of said at least one fan member is also preferably juxtaposed along said pole and an outer edge of said at least one fan member is positioned near an outermost portion of main umbrella fabric cover.

It is thus seen that preferably at least one fan member is removably attached to at least one of said main umbrella support members and one of said lower umbrella support arms.

The drive means of the present invention comprises a motor operably connected to rotate said upper hub, said main umbrella support members, said lower hub, said lower umbrella support arms, said main umbrella fabric cover and said at least one fan member relative to said pole. In one embodiment, the drive means preferably also comprises a drive gear and a driven gear and an upper support block, an upper support bearing which bears against said driven gear, and a motor frame having an upper support motor arm and a lower motor support arm.

In the presently preferred embodiment, the drive means further comprises a drive wheel, a driven wheel and a drive belt with an upper support block, an upper support bearing which bears against said driven wheel, a motor frame having an upper support motor arm and a lower motor support arm.

DETAILED DESCRIPTION OF THE PREFERRED EMBODIMENTS

Figure 1:
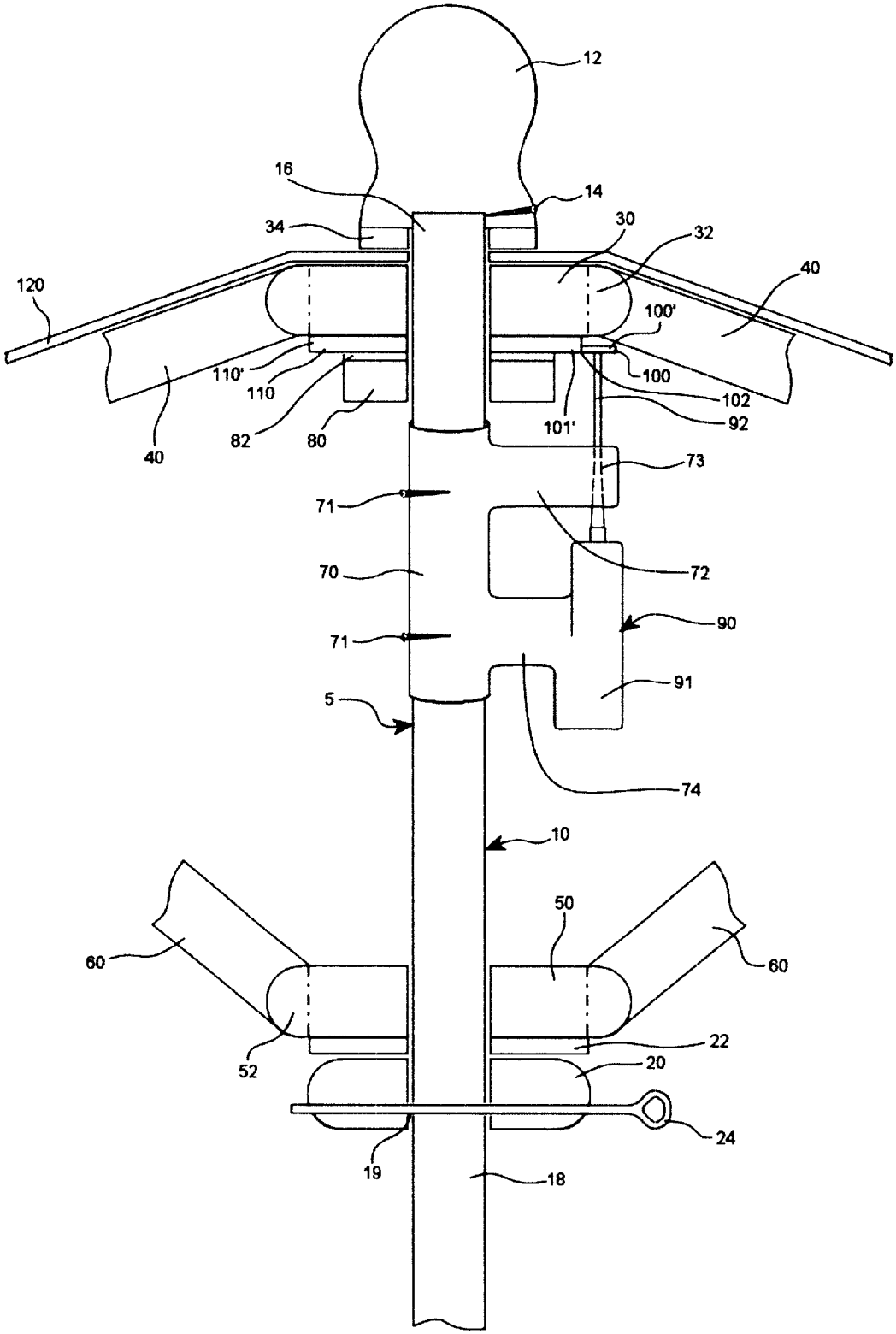
FIG. 1 is a cross section view of the umbrella of the present invention.

Referring to FIG. 1, the umbrella 5 includes a pole 10. Pole 10 has an upper end 16 and a lower end 18. A cap 12 is provided on upper end 16 of pole 10. The cap 12 is secured to upper end 16 of pole 10 by means of a cap screw 14. A hole 19 is provided from pole 10 for a pin 24 which will be described in greater detail hereinafter.

An upper hub 30 is provided which includes notches 32 for pivotal mounting of main umbrella support members 40.

Figure 3:
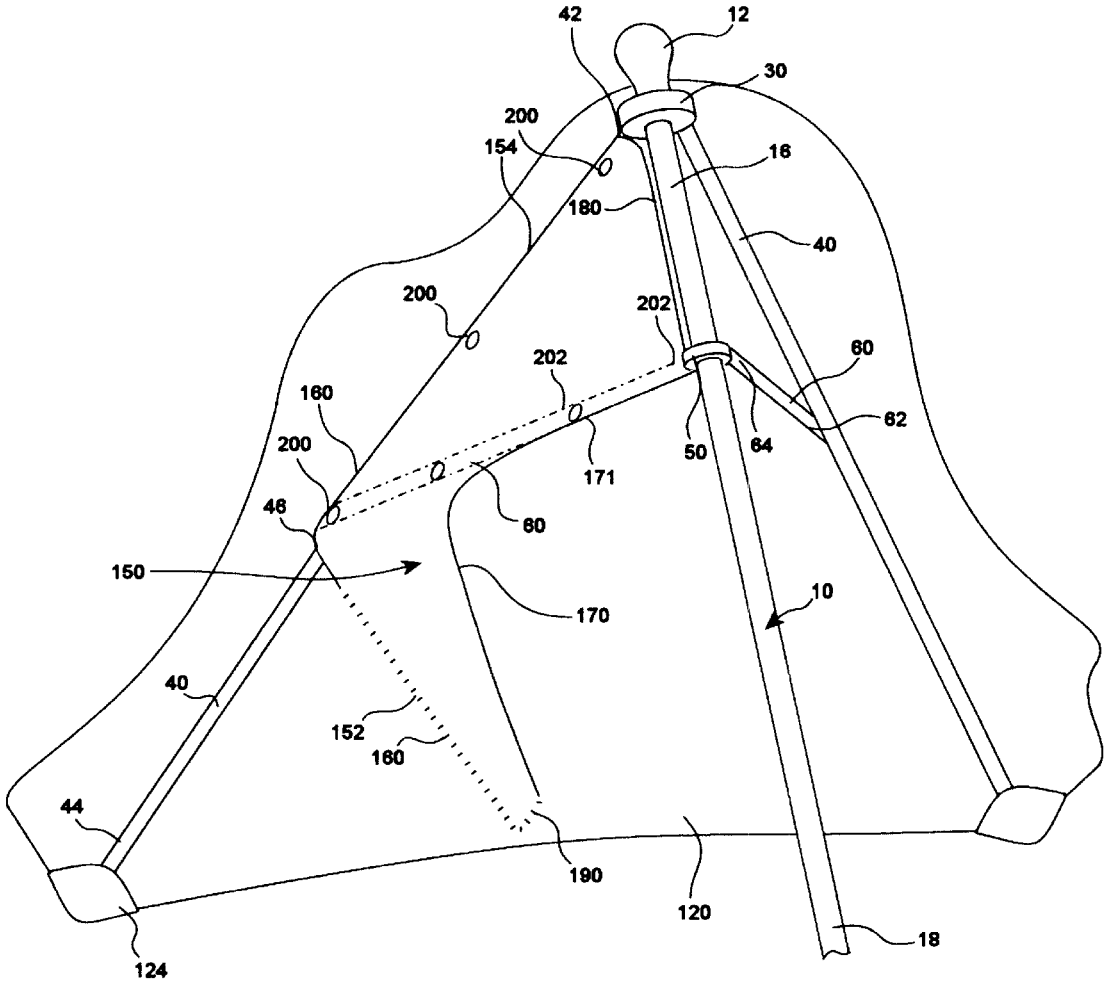
FIG. 3 is a perspective view showing in detail one of the fan members of the present invention.

Upper hub 30 also includes an upper bearing member 34. As shown in FIG. 3, main umbrella support members 40 are provided which each include an inner portion 42, a central portion 46 and an outermost portion 44. The innermost portion 42 of main umbrella support member 40 is pivotally attached in notch 32 of hub 30. Outermost portion 44 of main umbrella support member 40 are secured within a pocket 124 of a main umbrella fabric cover 120. Referring again to FIG. 1, a lower support block 20 is provided which supports a lower support block bearing member 22. The lower support block 20 is held in position against downward movement by lower support block pin 24 which, as previously indicated, is inserted through hole 19 and the lower end 18 of pole 10. A lower hub 50, which includes notches 52, is also provided. A plurality of lower umbrella support arms 60 having a first end pivotally attached to in notches 52 of lower hub 50 and having a second end pivotally attached to central portion 46 of main umbrella support members 40. Each of these connections are pivotal connections which allows the umbrella to be opened and closed between an open position and a closed position in the well known manner.

The present invention also includes a drive means 90 which preferably takes the form of a motor 91, drive shaft 92 and drive wheel 100'. This drive wheel 100' is used in connection with a drive belt 101' to drive driven wheel 110' thereby rotating certain components of the umbrella. In an alternative embodiment, rather than providing a belt driven arrangement as described above, in place of the drive wheel 100', a gear 100 may be provided. In place of driven wheel 110', a driven gear can be provided. In this alternative embodiment, drive gear 100 directly engages with and rotates driven gear 110. The principal of operation is the same in each embodiment.

The motor is held in place by a motor frame 70 which is secured to pole 10 by means of screws 71. Motor frame 70 includes upper support motor arm 73 and a lower support arm 74. Located above the motor frame 70 is an upper support block 80. Upper support block 80 includes an upper support bearing 82 which bears against the driven wheel 110' (or the driven gear 110).

Figure 2:
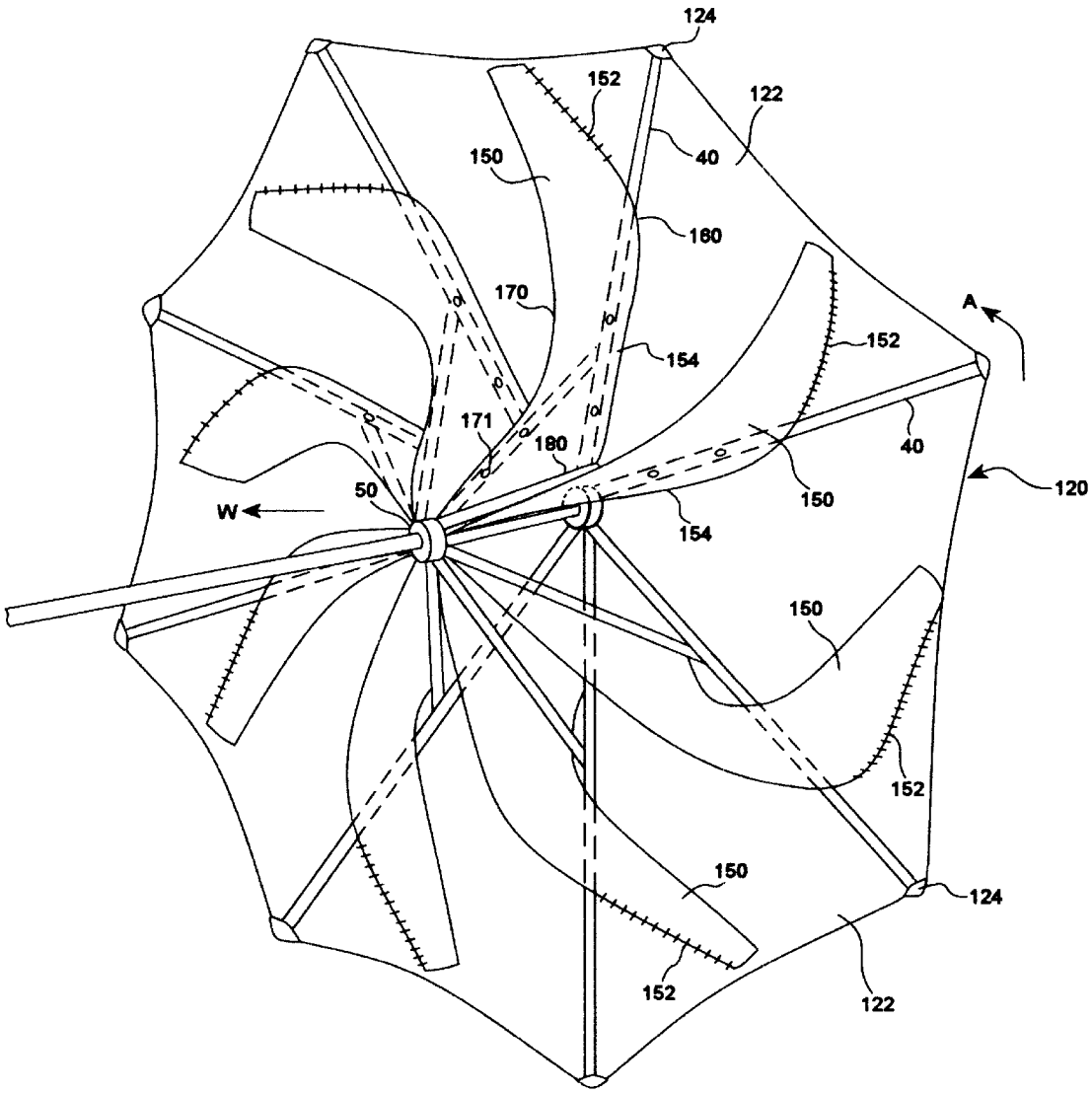
FIG. 2 is a perspective view of the lower side of the umbrella showing the downwardly depending fan members.

Referring to FIG. 2, it can be seen that a singular main umbrella fabric cover 120 is provided in the manner which is most commonly practiced with existing patio umbrellas. Such main umbrella fabric cover 120 is formed out of generally triangular segments 122 as shown in FIG. 2. These triangular segments 122 are sewn together. If desired, an additional piece of fabric (not shown) may be provided over a central portion of the main umbrella fabric cover 120. As shown in FIG. 2, each of the main umbrella support members 40 are attached within pockets 124 of the main umbrella fabric cover 120.

As will be obvious, the lower hub 50 is adapted for sliding motion on pole 10 allowing the umbrella to be moved from an open position to a closed position. Such operation is well known in the art.

Unlike any existing umbrellas, the present invention includes a plurality of downwardly extending fan members 150. Each fan member 150 has a top edge 160, a bottom edge 170 and an inner edge 180. A unique feature of the present invention is that the fan members 150 are attached to the main umbrella fabric cover 120 along an outer portion 152 of top edge 160 thereof. As shown, such attachment is preferably done by sewing the fan member directly onto the main umbrella fabric cover 120 but it may also be removably secured thereto by a variety of known means. As shown, the attachment of outer portion 152 preferably begins at a location intermediate the outermost end of two adjacent main umbrella support members 40. Such attachment continues toward a central portion 46 of one of said members 40. Attachment of portion 154 of edge 160 is preferably accomplished in a removable manner by means of snaps, Velcro, magnetic attachment or a zipper which are generally shown as snaps at locations 200. An inner portion 171 of a bottom edge 170 of the fan member 150 is removably attached to a lower support arm 60 by similar attaching means such as snaps 202 which may also take the form of a zipper, Velcro fasteners, magnetic fasteners or the like.

In use, the removable attachments 200 and 202 are disconnected to allow the umbrella to be folded into a closed position. Once the umbrella is opened, the attachments 200 and 202 are preferably secured. Alternatively, rather than providing an attachment at 202, it is also contemplated that the provision of weights along bottom edge 170 of the fan member 150 will cause the fan to function without such attachment. Once the umbrella is in a open position and the attachments are secured, the motor 91 causes various components of the umbrella to rotate relative to the pole 10. These components include the following: upper hub 30, main umbrella support members 40, lower hub 50, lower umbrella support arm 60, main umbrella fabric cover 120 and said at least one fan member 150. As will be obvious, the rotation of the umbrella in the rotational direction of arrow A shown in FIG. 2 will cause a flow of air to occur in the direction of arrow W shown in FIG. 2.

In an alternative embodiment of the invention (not shown) the top edge 160 of the fan member 150 is attached along substantially the entire length of a main umbrella support member 40.

Because of the unique design of the fan members, the present invention provides a fan umbrella which is lightweight, collapsible and extremely efficient in cooling individuals located beneath the umbrella.

While I have shown and described the presently preferred embodiments of my invention, the invention is not limited thereto and may be otherwise variously practiced within the scope of the following claims:

I claim:

1. A fan umbrella comprising:

a) a pole (10);

b) an upper hub (30);

c) a plurality of main umbrella support members (40);

d) a lower hub (50);

e) a plurality of lower umbrella support arms (60);

f) a main umbrella fabric cover (120) attached to said main umbrella support members (40);

g) at least one fan member (150) attached to said main umbrella fabric cover (120) and depending downwardly from said main umbrella fabric cover; and h) drive means (90) mounted to said pole (10) operably connected to said one of said upper hub (30) and said lower hub (50) and adapted to rotate said upper hub (30), said main umbrella support members (40), said lower hub (50), said lower umbrella support arms (60), said main umbrella fabric cover (120) and said at least one fan member (150) relative to said pole (10) whereby said at least one fan member directs a flow of air downwardly when said drive means is operating.

2. A fan umbrella according to claim 1 wherein said umbrella is movable between an open position and a closed position.

3. A fan umbrella according to claim 2 wherein said lower hub (50) is slidable on said pole (10) between an upper open position and a lower closed position, wherein said main umbrella support members (40) have an inner end (42), an outer end (44) and a central portion (46), and said main umbrella support members (40) are pivotally mounted at said inner end (42) thereof to said upper hub (30) and extend outwardly therefrom, wherein said plurality of lower umbrella support arms (60) are each pivotally connected at a first end (62) thereof to a central portion (46) of one of said main umbrella support members (40) and pivotally connected at a second end (64) thereof to said lower hub (50).

4. A fan umbrella according to claim 1 wherein said at least one fan member (150) is formed of a fabric material.

5. A fan umbrella according to claim 1 wherein said at least one fan member (150) is generally triangular in shape.

6. A fan umbrella according to claim 1 wherein said at least one fan member (150) consists of a plurality of fan members.

7. A fan umbrella according to claim 6 wherein said at least one fan member (150) consists of the same number of fan members as main umbrella support members (40).

8. A fan umbrella according to claim 1 wherein said at least one fan member (150) has a top edge (160), a bottom edge (170), and an inner edge (180), and wherein an outer portion (152) of a top edge (160) thereof attached to main umbrella fabric cover (120).

9. A fan umbrella according to claim 8 wherein said outer portion (152) of said top edge (160) of said at least one fan member (150) is sewn to said main umbrella fabric cover (120).

10. A fan umbrella according to claim 8 wherein said outer portion (152) of said top edge (160) of said at least one fan member (150) is removably attached to said main umbrella fabric cover (120).

11. A fan umbrella according to claim 10 wherein said outer portion (152) of said top edge (160) of said at least one fan member (150) is removable attached to said main umbrella fabric cover (120) with at least one of a zipper, Velcro fasteners, magnetic fasteners, and snaps.

12. A fan umbrella according to claim 1 wherein an inner portion (154) of a top edge (160) of said at least one fan member (150) is removably attached to a main umbrella support member (40).

13. A fan umbrella according to claim 12 wherein said inner portion (154) of said top edge (160) of said at least one fan member (150) is removable attached to said main umbrella support member (40) with at least one of a zipper, Velcro fasteners, magnetic fasteners, and snaps.

14. A fan umbrella according to claim 1 wherein an inner portion (171) of a bottom edge (170) of said at least one fan member (150) is removably attached to a lower support arm (60).

15. A fan umbrella according to claim 12 wherein said inner portion (171) of said bottom edge (170) of said at least one fan member (150) is removable attached to said umbrella support member (40) with at least one of a zipper, Velcro fasteners, magnetic fasteners, and snaps.

16. A fan umbrella according to claim 1 wherein an inner edge (180) of said at least one fan member (150) is juxtaposed along pole (10) and an outer edge (190) of said at least one fan member (150) positioned near an outermost portion of main umbrella fabric cover (120).

17. A fan umbrella according to claim 1 wherein said at least one fan member (150) is removably attached to at least one of said main umbrella support members (40) and one of said lower umbrella support arms.

18. A fan umbrella according to claim 1 wherein drive means (90) comprises a motor (91) operably connected to rotate said upper hub (30), said main umbrella support members (40), said lower hub (50), said lower umbrella support arms (60), said main umbrella fabric cover (120) and said at least one fan member (150) relative to said pole (10).

19. A fan umbrella according to claim 18 wherein drive means further comprises a drive gear (100) and a driven gear (110).

20. A fan umbrella according to claim 19 wherein said drive means further comprises an upper support block (80), an upper support bearing (82) which bears against said driven gear (110), a motor frame (70) having an upper support motor arm (73) and a lower motor support arm (74).

21. A fan umbrella according to claim 18 wherein drive means further comprises a drive wheel (100'), a driven wheel (110') and a drive belt (101').

22. A fan umbrella according to claim 21 wherein said drive means further comprises an upper support block (80), an upper support bearing (82) which bears against said driven wheel (110'), a motor frame (70) having an upper support motor arm (73) and a lower motor support arm (74).

* * * * *